United States Patent [19]

Morris et al.

[11] Patent Number: 5,013,414

[45] Date of Patent: May 7, 1991

[54] ELECTRODE STRUCTURE FOR AN ELECTROLYTIC CELL AND ELECTROLYTIC PROCESS USED THEREIN

[75] Inventors: Gregory J. E. Morris; Pierluigi A. V. Borrione; Umberto Leoni, all of Milan, Italy

[73] Assignees: The Dow Chemical Company, Midland, Mich.; Denora Permelec S.p.A., Milan, Italy

[21] Appl. No.: 340,605

[22] Filed: Apr. 19, 1989

[51] Int. Cl.[5] ..... C25B 1/14; C25B 11/03

[52] U.S. Cl. ..... 204/98; 204/128; 204/280; 204/284; 204/283; 204/286; 204/252; 204/253; 204/254; 204/292; 204/293

[58] Field of Search ..... 204/280, 292, 293, 242, 204/252, 98, 128, 286, 267–268, 253, 254, 284, 283

[56] References Cited

U.S. PATENT DOCUMENTS

| | | | |
|---|---|---|---|
| 3,752,757 | 8/1973 | Stephenson, III et al. | 204/256 |
| 3,788,966 | 1/1974 | Stephenson, III et al. | 204/256 |
| 3,859,197 | 1/1975 | Bouy et al. | 204/284 |
| 3,873,437 | 3/1975 | Pulver | 204/254 |
| 3,884,781 | 5/1975 | Bouy et al. | 204/98 |
| 3,909,378 | 9/1975 | Walmsley | 204/98 |
| 3,960,698 | 6/1976 | Bortak | 204/267 |
| 3,960,699 | 6/1976 | Bortak et al. | 204/268 |
| 4,017,375 | 4/1977 | Pohto | 204/255 |
| 4,025,405 | 5/1977 | Dotson et al. | 204/98 |
| 4,056,458 | 11/1977 | Pohto et al. | 204/263 |
| 4,065,366 | 12/1977 | Oda et al. | 204/98 |
| 4,096,054 | 6/1978 | Specht et al. | 204/263 |
| 4,111,779 | 9/1978 | Seko et al. | 204/255 |
| 4,115,236 | 9/1978 | Smura | 204/254 |
| 4,116,888 | 9/1978 | Ukihashi et al. | 521/31 |
| 4,123,336 | 10/1978 | Seko et al. | 204/98 |
| 4,126,588 | 11/1978 | Ukihashi et al. | 521/31 |
| 4,137,144 | 1/1979 | Kenney | 204/268 |
| 4,151,053 | 4/1979 | Seko et al. | 204/98 |
| 4,176,215 | 11/1979 | Molnar et al. | 521/27 |
| 4,178,218 | 12/1979 | Seko | 204/98 |
| 4,191,618 | 3/1980 | Coker et al. | 204/98 |
| 4,192,725 | 3/1980 | Dotson et al. | 204/98 |
| 4,194,670 | 3/1980 | Ichisaka et al. | 228/179 |
| 4,209,635 | 6/1980 | Munekata et al. | 560/183 |
| 4,212,713 | 7/1980 | Suhara et al. | 204/98 |
| 4,224,121 | 9/1980 | Dempsey et al. | 204/98 |
| 4,247,376 | 1/1981 | Dempsey et al. | 204/128 |
| 4,251,333 | 2/1981 | Suhara et al. | 204/98 |
| 4,270,996 | 6/1981 | Suhara et al. | 204/98 |
| 4,286,365 | 9/1981 | Creighton | 29/157.3 V |
| 4,315,810 | 2/1982 | Kircher | 204/257 |
| 4,329,435 | 5/1982 | Kimoto et al. | 521/38 |
| 4,330,654 | 5/1982 | Ezzell et al. | 526/243 |
| 4,337,137 | 6/1982 | Ezzell | 204/252 |
| 4,337,211 | 6/1982 | Ezzell et al. | 260/456 F |
| 4,340,452 | 7/1982 | deNora | 204/129 |
| 4,340,680 | 7/1982 | Asawa et al. | 521/27 |
| 4,345,986 | 8/1982 | Korach | 204/266 |
| 4,357,218 | 11/1982 | Seko | 204/98 |
| 4,358,412 | 11/1982 | Ezzell et al. | 260/968 |
| 4,358,545 | 11/1982 | Ezzell et al. | 521/27 |
| 4,364,815 | 12/1982 | Darlington et al. | 204/283 |
| 4,394,229 | 7/1983 | Korach | 204/98 |
| 4,409,074 | 10/1983 | Iijima et al. | 204/98 |
| 4,417,959 | 11/1983 | Kadija et al. | 204/98 |
| 4,444,632 | 4/1984 | deNora | 204/98 |
| 4,457,815 | 7/1984 | Levin | 204/98 |
| 4,457,823 | 7/1984 | LaConti et al. | 204/282 |
| 4,545,886 | 10/1985 | deNora et al. | 204/252 |
| 4,560,452 | 12/1985 | Morris et al. | 204/98 |
| 4,568,434 | 2/1986 | Morris et al. | 264/98 |
| 4,581,114 | 4/1986 | Morris et al. | 204/267 |
| 4,602,984 | 7/1986 | Beaver et al. | 204/59 R |
| 4,604,171 | 8/1986 | Morris et al. | 204/98 |
| 4,666,579 | 5/1987 | Beaver et al. | 204/253 |
| 4,666,580 | 5/1987 | Beaver et al. | 204/254 |
| 4,668,371 | 5/1987 | Pimlott et al. | 204/253 |
| 4,670,123 | 6/1987 | Pimlott et al. | 204/279 |
| 4,673,479 | 6/1987 | Morris et al. | 204/279 |
| 4,690,748 | 9/1987 | Beaver et al. | 204/279 |
| 4,698,143 | 10/1987 | Morris et al. | 204/253 |
| 4,705,614 | 11/1987 | Morris | 204/257 |
| 4,738,763 | 4/1988 | Abrahamson et al. | 204/255 |

*Primary Examiner*—John F. Niebling
*Assistant Examiner*—Kathryn Gorgos

[57] ABSTRACT

The invention is an electrode at least having a primary hydraulically permeable electrode member with a multiplicity of spaced apart depressions projecting a predetermined distance from the plane of the electrode. The invention also includes an electrolytic cell using the electrode and a method for electrolyzing an electrolyte using the cell.

83 Claims, 2 Drawing Sheets

ELECTRODE STRUCTURE FOR AN ELECTROLYTIC CELL AND ELECTROLYTIC PROCESS USED THEREIN

BACKGROUND OF THE INVENTION

The invention is an improved electrode structure for use in electrochemical cells. The invention can be used in monopolar cells and in bipolar cells. The invention is useful in cells which employ permselective ion exchange membranes disposed between parallel, foraminous, metal anode and cathode electrodes. It is particularly useful in cells having substantially flat anode and cathode electrodes mounted at a distance from a fluid impermeable barrier layer which physically separates adjacent electrolysis cells. Such membrane cells are useful in the electrolysis of aqueous solutions of alkali metal chlorides; especially in the electrolysis of aqueous sodium chloride solutions. The cells may also be used in electrolyzing other solutions to make products such as potassium hydroxide, iodine, bromine, bromic acid, persulfuric acid, chloric acid, adiponitrile and other organic compounds made by electrolysis.

Except for the structures used for the terminal cells of a bipolar filter press cell series, the structures for intermediate cells in a series of cells are similar, repetitious, cell structural units which are positioned adjacent to each other and held together by a variety of different means. Examples of such cells operated in a series are disclosed in U.S. Pat. No. 4,111,779 (Sept. 5, 1978) and in U.S. Pat. No. 4,017,375 (Apr. 12, 1977). These patents are herein incorporated by reference for purposes of showing representative prior art and for showing how bipolar filter press cells are formed into and operated in a cell series.

The above features of a flat plate bipolar electrode type, filter press type electrolytic cell unit can also be observed in the following references U.S. Pat. Nos. 4,364,815; 4,111,779; 4,115,236; 4,017,375; 3,960,698; 3,859,197; 3,752,757; 4,194,670; 3,788,966; 3,884,781; 4,137,144 and 3,960,699. A review of these patents discloses the above described structural elements in various forms, shapes and connecting means.

Further description of monopolar electrodes used in a filter press series of electrolytic cells are given in; (A) U.S. Pat. No. 4,056,458 issued to G. R. Pohto et al on Nov. 1, 1977, and assigned to Diamond Shamrock Corporation; and (B) U.S. Pat. No. 4,315,810 issued to M. S. Kircher on Feb. 16, 1982, and assigned to Olin Corporation. Both of these patents teach the use of one type structure to support the monopolar filter press cell unit and they teach the use of other structures (a plurality of conductor rods or bars) to distribute electricity from and electrical source located outside the cells to the monopolar electrode members disposed within the cell. Other complexities of monopolar filter press series which call for many parts and many connections are observed from a study of these two patents.

To assure the effective use of substantially all of the surface of the electrodes in both monopolar and bipolar cells, it is desirable to provide electrical current to the electrode relatively evenly and without excessive resistance losses. To accomplish this, workers in the prior art have devised a variety of mechanical designs by which electrical current may be efficiently delivered to the electrode.

It is common practice to operate electrolytic cells with a membrane in contact with the anode or cathode (as in a finite gap membrane cell) or in contact with both anode and cathode (as in zero gap membrane cell). It is because of the close relationship with the electrodes that great care must be taken at the point where the welded connection is in close contact with the membrane. The complexity of electrical power distribution to the membrane makes it almost impossible to obtain a uniform current distribution.

It is expected that the weld points, which are the main electrical contacts, would have the highest concentration of electrical power. As the electrical power is transmitted across the planar surface of the electrode, the electrical power dissipates in intensity. This phenomenon is of course due to the resistance of the electrode material to the transmission of electrical power. Because of this, it can also be expected that the membranes in the area of the welds will be subject to higher concentrations of electrical power than the outward sections of the membrane away from the weld points.

As to the welded connections, electrical transmission through them is also dependent upon the percentage of the cross-sectional area of the supposed welds which is actually welded. Maldistribution of the amount of welded surface area from weld to weld across the face of the electrode is very difficult to avoid. Thus, with maldistribution of welds, there occurs again an additional maldistribution of electric power to the membrane.

Another undesired effect of this type of electrical contact is the blinding of electrolyte feed to the adjoining section of the active electrode. Since the area occupied by the weld can vary substantially, the membrane section affected can also vary. The greater the blinded area caused by the weld, the greater the area of the membrane surface that can experience the lack of electrolyte flow. This lack of electrolyte flow can cause a depletion of chloride ions, which causes the evolution of oxygen. Such a side-reaction, besides entailing a loss of current efficiency, has a detrimental effect on the active life of the anodes which rapidly loose their catalytic activity when oxygen is evolved. On the other hand, membranes are also particularly sensitive to the caustic concentration on the cathode side. For this reason, it is also highly desirable to maintain the caustic concentration across the contact areas on the cathode side of the membrane.

Still another key operational consideration is to minimize the stagnation of chlorine gas in the anolyte chamber. Since the attachment of the electrode can leave small voids at the stand-off means, and since these areas may be isolated from electrolyte flow by the area occupied by the weld, chlorine gas can become trapped in these voids. This trapped chlorine can then penetrate into the membrane and precipitate sodium chloride crystals. This build up of sodium chloride crystals within the structure of the membrane can cause small separations which can eventually lead to pin holes or delamination of the layers of the membrane, rendering the membrane less efficient or even inoperable.

The present invention allows the construction of the anode and cathode for both bipolar electrode type and monopolar electrode type cell series which greatly improves the current distribution across the lateral surface of the anode and cathode electrodes. The invention also allows the removal of excess heat of reaction at the contact points, the removal of stagnated chlorine gas, greatly reducing the risk of depleting the electrolyte at the contact points and neutralizing the effects of back migration of corrosive electrolytes, by creating an electrode structure which is simpler, much more flexible, and yet economical to manufacture and operate.

STATEMENT OF THE INVENTION

The invention is an electrode at least having a primary hydraulically permeable electrode member with a multiplicity of spaced apart depressions projecting a predetermined distance from the plane of the electrode.

The invention also includes an electrolytic cell of the type having a central barrier with a plurality of spaced apart stand off means projecting therefrom, a membrane or diaphragm, and at least one electrode member, wherein the improvement comprises the electrode member having a multiplicity of spaced apart hydraulically permeable depressions projecting a predetermined distance from the plane of the electrode toward and contacting the stand off means.

The invention also includes a method for electrolyzing an electrolyte by passing electrical current between two electrodes that are separated by a membrane or diaphragm, wherein at least one of the electrodes has a multiplicity of spaced apart hydraulically permeable depressions projecting a predetermined distance from the plane of the electrode toward and electrically contacting the stand off means, wherein electrolyte is free to circulate in the area between the electrical contact points and the membrane.

GENERAL DESCRIPTION

Figure 1:
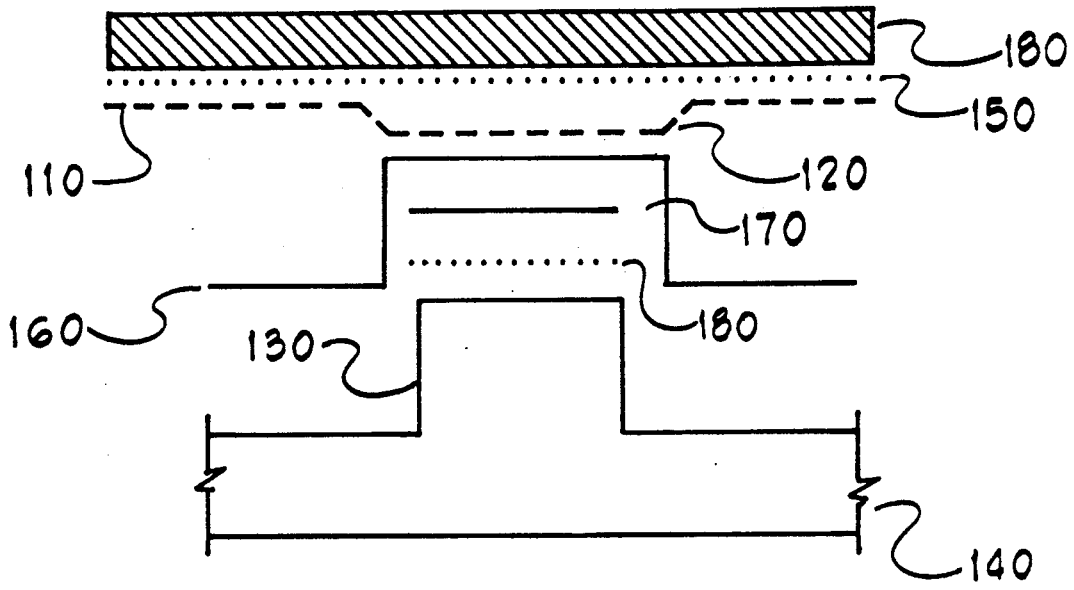
FIG. 1 shows a side view of one embodiment of a cell using the present invention. It shows the central barrier, an electrode having a depression in electrical contact with a stand off means projecting from the central barrier, a screen electrode, and an ion exchange membrane or diaphragm. Electrolyte can freely circulate between the electrical contact point and the membrane, thereby minimizing damage to the membrane.

The invention is an electrode structure suitable for use in electrolytic cells which provides free access of electrolyte to all portions of the active electrode. Free access of electrolyte to the membrane minimizes damage to the membrane because it assures that electrolyte contacts all areas of the active electrode during electrolysis. If portions of the areas where the active electrode is near the membrane 180 are not in contact with electrolyte, the membrane 180 is prone to drying and cracking as a result of operating with zones of depleted electrolyte, high temperature and high current density. The present invention preferably provides a two-component electrode that assures free electrolyte flow to all areas of the active electrode. The electrode is composed of a primary hydraulically permeable electrode member 110 and a secondary hydraulically permeable electrode member 150. The improvement of this cell structure comprises forming the primary hydraulically permeable electrode member 110 with a multiplicity of depressions 120 projecting a predetermined distance inward from the normally planar surface of the primary hydraulically permeable electrode member 110 toward the stand-off means 130 of the central barrier 140. The sum of the depth of the depressions 120 plus the height of the stand-off means 130 extending from the normally planar surface of the central barrier 140 determines the depth of the electrode compartment.

The depth of the depressions 120 from the normally planar surface of the electrode member may for example be in the range of from about 2 to about 18 millimeters (mm). To reduce, and preferably minimize excess load at the electrical contact points, the present invention can incorporate a non back-to-back relationship with the depressions 120 on the anodic and cathodic electrode members. This spacing is to provide additional protection from over-squeezing the membrane 180 at these points in the event the two electrodes come together, as in a zero gap-type membrane cell, or in the finite gap-type membrane cell, through operational errors where by the electrodes come together due to a pressure change in the electrolyte chambers, or in the event the tolerances of fabrication are such that during assembly the electrodes are allowed to touch.

Figure 2:
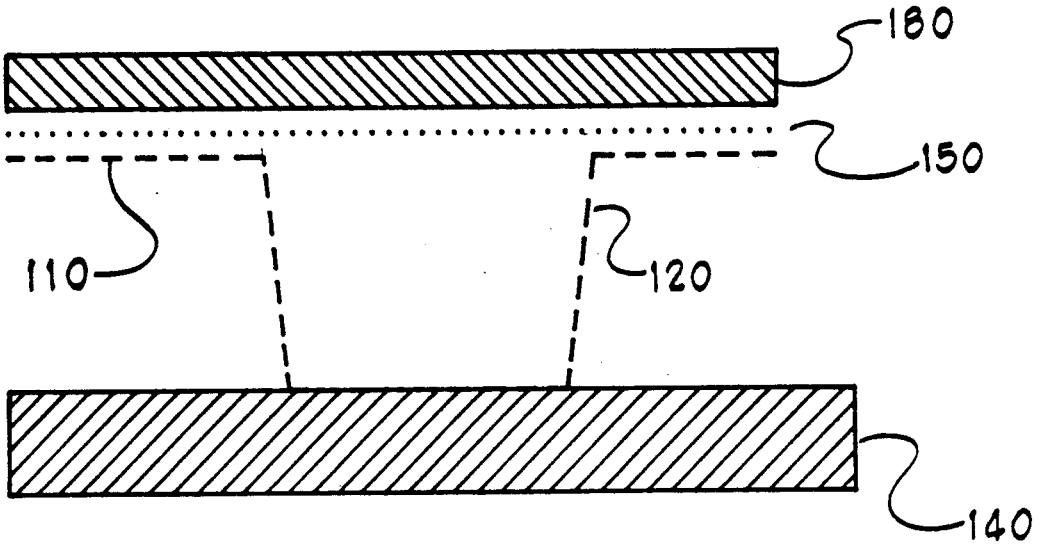
FIG. 2 shows a side view of one embodiment of a cell using the present invention. It shows connecting the electrode depressions directly to the central barrier, eliminating the need for an anode and cathode stand-off means. Electrolyte can freely circulate between the electrical contact point and the membrane, thereby minimizing damage to the membrane.

In most instances, it is desired that the anode and cathode electrode depressions be connected by welding to the anode and cathode stand-off means. However, as shown in FIG. 2, this invention includes connecting the electrode depressions 120 directly to the central barrier 140 eliminating the need for the anode and cathode stand-off means.

Electrode Generally

The electrode members can be the electrodes themselves at which electrochemical reactions occur, or they can be electrically conductive means for conducting electricity from the central barrier 140 to the actual electrodes themselves, which may be, for example, a solid polymer electrolyte which is bonded to the membrane 180. Usually the electrodes will have catalyst deposited upon them.

Electrodes preferably used in the present invention comprise at least a primary hydraulically permeable electrode member 110 and a secondary hydraulically permeable electrode member 150 adjacent to and in contact with the primary hydraulically permeable electrode member 110. The primary hydraulically permeable electrode member 110 is normally thicker, more rigid, more massive than the secondary hydraulically permeable electrode member 150 and provides support for the secondary hydraulically permeable electrode member 150. The secondary hydraulically permeable electrode member 150, on the other hand, is thinner, less massive, and generally not self supporting. When a secondary hydraulically permeable electrode member 150 is used along with the primary hydraulically permeable electrode member 110, the secondary hydraulically permeable electrode member 150 is the portion of the electrode that contacts the membrane 180, while the primary hydraulically permeable electrode member 110 contacts the secondary hydraulically permeable electrode member 150 and a central barrier 140.

In use, electrical current passes from the central barrier 140 through a plurality of stand-off means 130 and into the primary hydraulically permeable electrode member 110 of the electrode. From there, the electrical current flows from the primary hydraulically permeable electrode member 110 to the secondary hydraulically permeable electrode member 150. Preferably, the secondary hydraulically permeable electrode member 150 has its surface at least partially coated with catalytically active particles, so electrolysis occurs on the secondary hydraulically permeable electrode member 150. Optionally, the primary hydraulically permeable electrode member 110 also has catalytically active particles on its surface.

The primary hydraulically permeable electrode member 110 and the secondary hydraulically permeable electrode member 150 are preferably foraminous structures. Optionally the primary hydraulically permeable electrode member 110 and the secondary hydraulically permeable electrode member 150 may be current collectors which contact an electrode which is bonded to the membrane 180 (M&E discussed later). Electrodes may optionally have a catalytically active coating on their surface. The electrode may be any suitable structure such as wire mesh, woven wire, punched plate, metal sponge, expanded metal, perforated or unperforated metal sheet, flat or corrugated lattice works, spaced metal strips or rods, or other forms known to those skilled in the art, the precise structure is not critical.

The primary hydraulically permeable electrode member 110, when used alone, is usually at least partially coated with an electrocatalytic material which is designed to enhance the electrochemical reactions that occur when the electrode is used in an electrochemical cell.

Central Barrier

The central barrier 140 of the present invention serves as both: (1) a means to conduct electrical current to the primary hydraulically permeable electrode member 110 and the secondary hydraulically permeable electrode member 150 of the unit; and (2) a support means to hold the primary hydraulically permeable electrode member 110 and the secondary hydraulically permeable electrode member 150 in a desired position.

The central barrier 140 may be used in a variety of cell designs and configurations. The central barrier 140 may be made of any material which conducts electrical current throughout the central barrier 140 and to the primary hydraulically permeable electrode member 110 and the secondary hydraulically permeable electrode member 150 of a monopolar unit. The central barrier 140 has a large mass and a low resistance to electrical flow and provides a pathway for the distribution of electrical energy substantially evenly to all parts of the primary hydraulically permeable electrode member 110 and the secondary hydraulically permeable electrode member 150. The central barrier 140 is substantially rigid. As used herein, "substantially rigid" means that it is self-supporting and does not flex much under its own weight under normal circumstances; moreover, it is essentially more rigid and more massive than the primary hydraulically permeable electrode member 110 and the secondary hydraulically permeable electrode member 150.

Preferably, the material of the central barrier 140 is selected from the group consisting of iron, steel, stainless steel, nickel, aluminum, copper, magnesium, lead, alloys of each and alloys thereof. More preferably, the material of the central barrier 140 is selected from the group consisting of ferrous materials. Ferrous materials are defined herein to mean metallic materials whose primary constituent is iron.

The central barrier 140 preferably has a sufficiently large cross sectional area to minimize its electrical resistance. The fact that the central barrier 140 has a large cross sectional area allows the use of materials having a higher resistivity than could be used in configurations of the prior art. Thus, materials such as iron, steel, ductile iron and cast iron are perfectly suitable for use in the present invention. More specifically, materials having a resistivity as high or greater than copper may be economically used to form the central barrier 140. More economically, materials having a resistivity greater than about 10 microohms-cm can be used. Most economically, materials having resistivities as high as, or higher, than 50 microohms-cm can be used.

The central barrier 140 preferably provides the structural integrity required to physically support the adjacent electrolyte compartments while loaded with electrolyte as well as to support the primary hydraulically permeable electrode member 110 and the secondary hydraulically permeable electrode member 150.

Each end member and each monopolar unit has an electrical connection means connecting an external power supply to the central barrier 140. The connecting means may be integral with or attached to the sealing means or it may pass through an opening in the sealing means and connect to the central barrier 140. The electrical connection may also be connected to the central barrier 140 at a plurality of locations around the sealing means to improve the current transmission into the central barrier 140. The electrical connection means may be an opening in the sealing means or in the central barrier 140 to which a power supply cable is attached. More preferably, the electrical connection means is an integral part of the central barrier 140. That is, the electrical connection means is made of the same material as the central barrier 140 thereof and it forms a single body without discontinuities in the material forming the electric current transmission body. Most practically, this connection means is an extension of the central barrier 140 of the body, which projects outside the perimeter of the frame or sealing flange portion along one side thereof, for a length sufficient to provide easy connection to a bus bar.

The central barrier 140 for the bipolar cell unit is the same as that described above for the monopolar cell unit, with the exception that each bipolar central barrier 140 does not have a means for electrically connecting it to the external power source. Rather, it is electrically connected in series to the central barriers adjacent to it.

The bipolar central barrier can be constructed from the same materials described as suitable for use as a monopolar central barrier (above). Also, a number of plastic materials are suitable for use. Without intending to be limited by the specific organic materials hereinafter delineated, examples of such suitable materials include polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; and fluoroplastics and copolymers thereof. It is preferred that a material such as polypropylene be used for the structural member since it produces a shape with adequate structural integrity at elevated temperatures, is readily available, and is relatively inexpensive with respect to other suitable materials.

It is preferred that a material such as polypropylene be used for the bipolar central barrier since it produces a shape with adequate structural integrity at elevated temperatures, is readily available, and is relatively inexpensive with respect to other suitable materials.

Stand-off Means

The central barrier 140 has a plurality of stand-off means 130 projecting a predetermined distance outwardly from a central barrier 140 into the electrolyte compartment adjacent to the central barrier 140. These stand-off means 130 are capable of being mechanically and electrically connected either directly to the electrodes or indirectly to the electrode component through at least one compatible intermediate body situated between the electrode component and each of the stand-off means 130. The stand-off means 130 are substantially solid. They may, however, contain internal voids, as a result of casting.

The primary hydraulically permeable electrode member 110 and the secondary hydraulically permeable electrode member 150 are preferably welded to the stand-off means 130.

The stand-off means 130 are preferably integral with the central barrier 140 and are preferably formed when the central barrier 140 is cast. Thus, they are preferably composed of the same material as the central barrier 140. Since some materials are difficult to weld, the stand-off means 130 may optionally be composed of a different material than the central barrier 140. To form such an central barrier 140, rods may be placed in a mold where the stand-off means 130 are to be positioned, and a castable material may be cast around the rods.

The stand-off means 130 are preferably spaced apart in a fashion to rigidly support the primary hydraulically permeable electrode member 110 and the secondary hydraulically permeable electrode member 150. The frequency of stand-off means 130, whether of round cross section or of elongated or rib-type cross section, per unit area of the flat electrode elements associated therewith may vary within ample limits. The separation between adjacent stand-off means will generally depend upon the plane resistivity of the particular electrode element used. For thinner and/or highly resistive electrode elements, the spacing of the stand-off means will be smaller, thus, providing a more dense multiplicity of points or electrical contact; while for thicker and/or less resistive electrode elements, the spacing of the stand-off means may be larger. Normally, the spacing between the stand-off means is within 5 and 30 centimeters (cm) although smaller and larger spacing may be used in accordance with overall design considerations.

The flat electrode members associated therewith may vary within ample limits. The separation between adjacent stand-off means 130 will generally depend upon the plane resistivity of the particular electrode member used. For thinner and/or highly resistive electrode members, the spacing of the stand-off means 130 will be smaller, thus, providing a more dense plurality of points or electrical contact; while for thicker and/or less resistive electrode members, the spacing of the stand-off means 130 may be larger. Normally, the spacing between the stand-off means 130 is within 5 and 30 centimeters (cm) although smaller and larger spacing may be used in accordance with overall design considerations.

It should be noted here that although stand-off means 130 are frequently in a back to back relationship across central barrier 140, they need not be. They can also be offset from each other across the planar portion of the central barrier 140 and may have more than one cross-sectional configuration.

Of course, contrary to the bipolar central barrier 140, in the monopolar cell, the stand-off means 130 on both sides of the central barrier 140 are of the same kind; i.e. the stand-off means 130 on both sides are all anode stand-off means 130 or they are all cathode stand-off means 130. The terminal cells for a monopolar stack are end cells with only one side requiring an electrode.

Electrode Compartments

These anolyte and catholyte compartments adjacent to the central barrier 140 have a peripheral structure (a thick part of the central barrier 140) around their periphery to complete the physical definition of the catholyte compartment and of the anolyte compartment.

Electrodes

For use in chlor-alkali cells, it is preferred that the materials of construction of the anolyte side electrode be selected from the group consisting of titanium, titanium alloys, tantalum, tantalum alloys, niobium, niobium alloys, hafnium, hafnium alloys, zirconium and zirconium alloys, and it is preferred that the material of construction of the catholyte side electrode be selected from the group consisting of ferrous materials, nickel, nickel alloys, chromium, magnesium, tantalum, cadmium, zirconium, lead, zinc, vanadium, tungsten, iridium, stainless steel, molybdenum, cobalt or alloys thereof.

Liner

A further element which this invention optionally includes is a liner 160 made of a corrosion-resistant metal sheet fitted over those surfaces of the central barrier 140 which would otherwise be exposed to the corrosive environment of the electrolyte compartment.

Preferably, the liner 160 is an electrically conductive metal substantially resistant to the corrosion of the electrolyte compartment environment. Preferably the liner 160 is formed so as to fit over, and connect to, the central barrier 140 at the stand-off means 130 and, more preferably, at the ends of the stand-off means 130.

More preferably, the invention comprises the liner 160 being sufficiently depressed around the spaced stand-off means 130 toward the central barrier 140 in the spaces between the stand-off means 130 so as to allow free circulation of the electrolyte between the lined central barrier 140 and the separator or the adjacent electrolyte compartment.

It is not necessary that the liner 160 be depressed around the spaced stand-off means 130 as to contact the planar surface of the central barrier 140; preferably, the liner 160 will rest solely over the top surfaces of the stand-off means 130 and over the surface of the flange portion of the central barrier 140.

In situations where the liner 160 is not weldably compatible with the metal of the central barrier 140, then in order to be able to weld the liner 160 to the central barrier 140, metal coupons 170 and 185 may be situated in an abutting fashion between the stand-off means 130 and the liner 160. The metal layer of the coupons 170 and 185 which abut each boss is weldably compatible with the material which the stand-off means 130 are made and accordingly being welded to said stand-off means 130. The metal layer of that side of the coupons 170 and 185 abutting the liner 160 is weldably compatible with the metallic material of which the liner 160 is made and accordingly is welded to said liner 160 so that the liner 160 is welded to the stand-off means 130 through the coupons 170 and 185. In most instances, wafers made of a single metal or metal alloy serve quite well as intermediates. In some cases, these coupons may need to be bilayer to achieve compatible welds between the boss 130 and/or central barrier 140 and the liner 160.

A second method of connecting the liner 160 to the current central barrier 140 may be achieved by using two, single-metal coupons. For example, a vanadium coupon may be placed next to a ferrous boss with a second coupon, such as titanium, between the vanadium coupon and a titanium liner 160. Another way of connecting the liner 160 to the central barrier 140, when these metals are weldably incompatible, is through the use of explosion bonding. Such methods are known in the art. See, for example, U.S. Pat. No. 4,111,779.

In chlor-alkali cells, a liner 160 is most commonly used in anode units and is less frequently used to line cathode units. However, those processes where the electrochemical cell is used to produce caustic concentrations greater than about 22 weight percent caustic solution, a catholyte liner 160 may be desirably used. The catholyte liner 160 is made from an electrically conductive material which is substantially resistant to corrosion due to the catholyte compartment environment. Plastic liners may be used in some cases where provision is made for electrically connecting the cathode to the cathode stand-off means 130 throughout the plastic. Also, combinations of plastic and metal liners may be used. The same is true for anolyte liners.

The liners for the catholyte unit are preferably selected from the group consisting of ferrous materials, nickel, stainless steel, chromium, monel and alloys thereof.

The liners for the anode unit are preferably selected from the group consisting of titanium, vanadium, tantalum, columbium, hafnium, zirconium, and alloys thereof.

In cases where the present invention is used to produce chlorine and caustic by the electrolysis of an aqueous brine solution, it is most preferred that the anolyte units be lined with titanium or a titanium alloy, the catholyte units be lined with nickel or a nickel alloy and the central barrier 140 be of a ferrous material.

Membrane

Representative of the types of ion exchange membranes envisioned for use with this invention are those disclosed in the following U.S. Pat Nos.: 3,909,378; 4,329,435; 4,065,366; 4,116,888; 4,126,588; 4,209,635; 4,212,713; 4,251,333; 4,270,996; 4,123,336; 4,151,053; 4,176,215; 4,178,218; 4,340,680; 4,357,218; 4,025,405; 4,192,725; 4,330,654; 4,337,137; 4,337,211; 4,358,412; and 4,358,545. These patents are hereby incorporated by reference for the purpose of the membranes they disclose.

Process Parameters

In operating the present electrochemical cell as a chlor-alkali cell, a sodium chloride brine solution is fed into anolyte compartments and water is optionally fed into catholyte compartments. Electric current from a power supply is passed between anodes and cathodes. The current is at a voltage sufficient to cause electrolytic reactions to occur in the brine solution. Chlorine is produced at the anode while caustic and hydrogen are produced as the cathode.

In chlor-alkali processes, it is preferable to maintain the pH of the anolyte at a range of from about 0.5 to about 5.0 during electrolysis. In most cases it is desirable to operate the electrolytic cell of the present invention at a current density as high as possible, to minimize the number of cells required to produce a given amount of products.

Multivalent ions in the electrolyte tend t foul the ion exchange membrane 180. Thus, it is desirable to minimize the concentration of multivalent ions. Preferably, they are kept at concentrations less than about 0.08 milligram(s) per liter of electrolyte. Since calcium ions frequently foul ion exchange membranes, it is preferable to maintain the concentration of calcium in the electrolyte at less than about 0.05 milligram(s) of calcium per liter of electrolyte. Brine may be contacted with a chelating ion exchange resin to reduce the concentration of calcium to a level of less than about 0.05 milligram(s) calcium per liter of solution, prior to the electrolyte being introduced into the electrolytic cell.

Another way to minimize fouling of the ion exchange membrane 180 is to remove carbon dioxide from the electrolyte. Preferably, the carbon dioxide concentration in the electrolyte is less than about 70 parts per million as measured just prior to the brine being electrolyzed when the pH of the brine is maintained at a level lower than 3.5 by a process which includes the addition of hydrochloric acid to the brine prior to its being electrolyzed. It has also been determined that it is desirable to use electrolyte having a silica concentration of less than about 4 milligrams of silica per liter of electrolyte. Sulfate is another ion that is preferably minimized. It is desired to keep the sulfate level of the electrolyte at a level less than about 5 grams sulfate per liter of electrolyte.

The pressure in the catholyte chamber may conveniently be maintained at a slightly greater pressure than the pressure of the anolyte compartment so as to gently urge the permselective, ion exchange membrane 180 separating the two compartments toward or against the "flat plate" foraminous anode disposed parallel to the planarly disposed membrane; which anode is electrically and mechanically connected to the anode stand-off means 130 of the central barrier 140.

The catholyte or the anolyte may be circulated through their respective compartments, as is known in the art. The circulation can be forced circulation, or gas lift circulation caused by the gases rising from the electrodes where they are produced.

In the electrolysis of aqueous solutions of sodium chloride as cell feed, the cell operates as follows. The feed brine is continuously fed into anolyte compartment via a duct while fresh water may optionally be fed into catholyte compartment via an inlet duct. Electric power (D.C.) is applied across the cell series in such a fashion so that the anode of each electrolysis cell is positive with respect to the negative cathode of that electrolysis cell. Excluding depolarized cathodes or anodes, the electrolysis proceeds as follows. Chlorine gas is continuously produced at the anode; sodium cations are transported through membrane 180 to the catholyte compartment by the electrostatic attraction of the cathode. In the catholyte compartment, there is hydrogen gas and an aqueous solution of sodium hydroxide continuously formed. The chlorine gas and depleted brine continuously flow from the anolyte chamber via a duct while the hydrogen gas and sodium hydroxide continuously exit the catholyte compartment by a duct.

Depolarized electrodes can be used to suppress the production of hydrogen or chlorine o both if desired.

Other Cell Designs

The present invention may be used in conjunction with a zero gap cells wherein the electrode is embedded in, bonded to, or pressed against an ion exchange membrane 180. In these cases, it is desirable to use a current collector between the stand-off means 130 and the electrode. The current collector distributes electrical current to the electrode. Such cells are illustrated in U.S. Pat. Nos. 4,394,229; 4,345,986; 4,417,959; 4,545,886; 4,247,376; 4,409,074; 4,738,763; 4,286,365; 3,873,437; and 4,096,054.

Of course, it is within the scope of this invention for the electrolysis cell formed between the two units to be a multi-compartment electrolysis cell using more than one membrane, e.g., a three compartment cell with two membranes spaced from one another so as to form a compartment between them as well a the compartment formed on the opposite side of each membrane between each membrane and its respective adjacent filter press unit.

Optionally, an oxygen containing gas may be fed to one side of the cathode, and the cathode operated as an oxygen depolarized cathode. Likewise, hydrogen may be fed to one side of the anode, and the anode operated as a depolarized anode. The types of electrodes and the procedures of operating them are well known in the art. Conventional means for the separate handling of gaseous and liquid reactants to a depolarized cathode may be used.

The present invention is suitable for use with the newly developed membrane/electrode cells (M&E cells), also known as solid polymer electrolyte cells. M&E's are an ion exchange membrane having an electrically conductive material embedded in or bonded to the ion exchange membrane. Such electrodes are well known in the art and are illustrated in, for example, U.S. Pat. Nos. 4,457,815; 4,224,121; 4,191,618; and 4,457,823. These two patents are hereby incorporated by reference for the purposes of the solid polymer electrolyte electrodes which they teach.

In addition, other cell components may be used in the cell of the present invention. For example, the mattress structure taught in U.S. Pat. No. 4,444,632 may be used to hold the ion exchange membrane in physical contact with one of the electrodes of the cell. Various mattress configurations are illustrated in U.S. Pat. No. 4,340,452. The mattresses illustrated in U.S. Pat. No. 4,340,452 may be used with both solid polymer electrolyte cells and zero gap cells. These patents are incorporated by reference for the purposes of the cell elements that they teach.

What is claimed is:

1. A substantially planar primary hydraulically permeable electrode member having a plurality of spaced apart depressions located at positions throughout the electrode member, wherein said depressions correspond in location to a plurality of stand-off means on a central barrier support means.

2. The electrode member of claim 1 wherein the electrode is composed of an electrically conductive material.

3. The electrode member of claim 2 wherein the electrically conductive material is selected from the group consisting of titanium, titanium alloys, tantalum, tantalum alloys, niobium, niobium alloys, hafnium, hafnium alloys, zirconium, zirconium alloys, nickel, nickel alloys, chromium, tantalum, cadmium, zirconium, lead, zinc, vanadium, tungsten, iridium and cobalt.

4. The electrode member of claim 3 wherein the electrically conductive material is selected from the group consisting of titanium or a titanium alloy.

5. The electrode member of claim 4 wherein a secondary hydraulically permeable electrode member is placed over the primary hydraulically permeable electrode member to provide a secondary distribution of electrical power and to provide a cover for one or more depressions in the primary hydraulically permeable electrode member.

6. The electrode member of claim 5 which further comprises the attachment to the primary hydraulically permeable electrode member in a manner such that the secondary hydraulically permeable electrode member is electrically and mechanically attached to the primary hydraulically permeable electrode member.

7. The electrode member of claim 6 wherein the primary hydraulically permeable electrode member is attached to the secondary hydraulically permeable electrode member by welding.

8. The electrode member of claim 3 wherein a secondary hydraulically permeable electrode member is placed over the primary hydraulically permeable electrode member to provide a secondary distribution of electrical power and to provide a cover for one or more depressions in the primary hydraulically permeable electrode member.

9. The electrode member of claim 8 which further comprises the attachment to the primary hydraulically permeable electrode member in a manner such that the secondary hydraulically permeable electrode member is electrically and mechanically attached to the primary hydraulically permeable electrode member.

10. The electrode member of claim 9 wherein the primary hydraulically permeable electrode member is attached to the secondary hydraulically permeable electrode member by welding.

11. The electrode member of claim 10 wherein the secondary hydraulically permeable electrode member has a greater flexibility than that of the primary hydraulically permeable electrode member.

12. The electrode member of claim 2 wherein a secondary hydraulically permeable electrode member is placed over the primary hydraulically permeable electrode member to provide a secondary distribution of electrical power and to provide a cover for one or more depressions in the primary hydraulically permeable electrode member.

13. The electrode member of claim 12 which further comprises the attachment to the primary hydraulically permeable electrode member in a manner such that the secondary hydraulically permeable electrode member is electrically and mechanically attached to the primary hydraulically permeable electrode member.

14. The electrode member of claim 13 wherein the primary hydraulically permeable electrode member is attached to the secondary hydraulically permeable electrode member by welding.

15. The electrode member of claim 1 wherein a secondary hydraulically permeable electrode member is placed over the primary hydraulically permeable electrode member to provide a secondary distribution of electrical power and to provide a cover for one or more depressions in the primary hydraulically permeable electrode member.

16. The electrode member of claim 15 which further comprises the attachment to the primary hydraulically permeable electrode member in a manner such that the secondary hydraulically permeable electrode member is electrically and mechanically attached to the primary hydraulically permeable electrode member.

17. The electrode member of claim 16 wherein the primary hydraulically permeable electrode member is attached to the secondary hydraulically permeable electrode member by welding.

18. The electrode member of claim 15 wherein the depth of one or more depressions from the normally planar surface of the primary hydraulically permeable electrode member is in the range of from about 2 to about 18 millimeters.

19. The electrode member of claim 15 wherein the secondary hydraulically permeable electrode member has a thickness in the range of from about 0.1 to about 1 millimeter.

20. The electrode member of claim 1 wherein the depth of one or more depressions from the normally planar surface of the primary hydraulically permeable electrode member is in the range of from about 2 to about 18 millimeters.

21. The electrode member of claim 1 wherein the volume of one or more depressions is in the range of from about 0.06 cubic centimeter to about 11.6 cubic centimeter.

22. An electrolysis cell having:

(a) a planar central barrier with a plurality of stand-off means projecting outward from opposing faces of the central barrier, (b) a substantially planar primary hydraulically permeable electrode member having a plurality of spaced apart depressions located at positions throughout the electrode member, wherein at least a portion of the stand-off means from the central barrier are connected with at least a portion of one or more depressions on the electrode member.

23. The electrolysis cell of claim 22 wherein the electrode member is composed of an electrically conductive material.

24. The electrolysis cell of claim 23 wherein the electrically conductive material is selected from the group consisting of titanium, titanium alloys, tantalum, tantalum alloys, niobium, niobium alloys, hafnium, hafnium alloys, zirconium, zirconium alloys, nickel, nickel alloys, chromium, tantalum, cadmium, zirconium, lead, zinc, vanadium, tungsten, iridium and cobalt.

25. The electrolysis cell of claim 24 wherein the electrically conductive material is selected from the group consisting of titanium or a titanium alloy.

26. The electrolysis cell of claim 25 wherein a secondary hydraulically permeable electrode member is placed over the primary hydraulically permeable electrode member to provide a secondary distribution of electrical power and to provide a cover for one or more depressions in the primary hydraulically permeable electrode member.

27. The electrolysis cell of claim 26 which further comprises the attachment to the primary hydraulically permeable electrode member in a manner such that the secondary hydraulically permeable electrode member is electrically and mechanically attached to the primary hydraulically permeable electrode member.

28. The electrolysis cell of claim 27 wherein the primary hydraulically permeable electrode member is attached to the secondary hydraulically permeable electrode member by welding.

29. The electrolysis cell of claim 24 wherein a secondary hydraulically permeable electrode member is placed over the primary hydraulically permeable electrode member to provide a secondary distribution of electrical power and to provide a cover for one or more depressions in the primary hydraulically permeable electrode member.

30. The electrolysis cell of claim 29 which further comprises the attachment to the primary hydraulically permeable electrode member in a manner such that the secondary hydraulically permeable electrode member is electrically and mechanically attached to the primary hydraulically permeable electrode member.

31. The electrolysis cell of claim 30 wherein the primary hydraulically permeable electrode member is attached to the secondary hydraulically permeable electrode member by welding.

32. The electrolysis cell of claim 31 wherein the secondary hydraulically permeable electrode member has a greater flexibility than that of the primary hydraulically permeable electrode member.

33. The electrolysis cell of claim 23 wherein a secondary hydraulically permeable electrode member is placed over the primary hydraulically permeable electrode member to provide a secondary distribution of electrical power and to provide a cover for one or more depressions in the primary hydraulically permeable electrode member.

34. The electrolysis cell of claim 33 which further comprises the attachment to the primary hydraulically permeable electrode member in a manner such that the secondary hydraulically permeable electrode member is electrically and mechanically attached to the primary hydraulically permeable electrode member.

35. The electrolysis cell of claim 34 wherein the primary hydraulically permeable electrode member is attached to the secondary hydraulically permeable electrode member by welding.

36. The electrolysis cell of claim 22 wherein a secondary hydraulically permeable electrode member is placed over the primary hydraulically permeable electrode member to provide a secondary distribution of electrical power and to provide a cover for one or more depressions in the primary hydraulically permeable electrode member.

37. The electrolysis cell of claim 36 which further comprises the attachment to the primary hydraulically permeable electrode member in a manner such that the secondary hydraulically permeable electrode member is electrically and mechanically attached to the primary hydraulically permeable electrode member.

38. The electrolysis cell of claim 37 wherein the primary hydraulically permeable electrode member is attached to the secondary hydraulically permeable electrode member by welding.

39. The electrolysis cell of claim 36 wherein the depth of one or more depressions from the normally planar surface of the primary hydraulically permeable electrode member is in the range of from about 2 to about 18 millimeters.

40. The electrolysis cell of claim 36 wherein the secondary hydraulically permeable electrode member has a thickness in the range of from about 0.1 to about 1 millimeter.

41. The electrolysis cell of claim 22 wherein the depth of one or more depressions from the normally planar surface of the primary hydraulically permeable electrode member is in the range of from about 2 to about 18 millimeters.

42. The electrolysis cell of claims 22 wherein the volume of one or more depressions is in the range of from about 0.06 cubic centimeter to about 11.6 cubic centimeter.

43. The electrolysis cell of claim 22 wherein the primary hydraulically permeable electrode member is attached to the stand-off means by welding.

44. A plurality of the electrolysis cell of claim 22 assembled into a filter press type cell series.

45. A plurality of electrolysis cells of claim 44 which include electrical leads attached to each electrolysis cell.

46. The plurality of electrolysis cells of claim 45 wherein a cation exchange membrane is used to separate an anode compartment from an cathode compartment.

47. The cell of claim 46 wherein the secondary hydraulically permeable electrode member includes a compressible electroconductive mat between the stand off means and the membrane and means are provided to press the electrode member and the membrane together.

48. The plurality of electrolysis cells of claim 44 wherein a cation exchange membrane is used to separate an anode compartment from an cathode compartment.

49. The cell of claim 48 wherein the secondary hydraulically permeable electrode member includes a compressible electroconductive mat between the stand off means and the membrane and means are provided to press the electrode member and the membrane together.

50. An electrolytic method comprising passing electrical current between an anode and a cathode, wherein at least one of the anode or the cathode is a hydraulically permeable electrode member which has a plurality of spaced apart depressions located at points substantially throughout the primary hydraulically permeable electrode member, said depressions being in mechanical and electrical contact with stand-off means emanating outward from a central barrier.

51. The electrolytic method of claim 50 wherein the electrode member is composed of an electrically conductive material.

52. The electrolytic method of claim 51 wherein the electrically conductive material is selected from the group consisting of titanium, titanium alloys, tantalum, tantalum alloys, niobium, niobium alloys, hafnium, hafnium alloys, zirconium, zirconium alloys, nickel, nickel alloys, chromium, tantalum, cadmium, zirconium, lead, zinc, vanadium, tungsten, iridium and cobalt.

53. The electrolytic method of claim 52 wherein the electrically conductive material is selected from the group consisting of titanium or a titanium alloy.

54. The electrolytic method of claim 53 wherein a secondary hydraulically permeable electrode member is placed over the primary hydraulically permeable electrode member to provide a secondary distribution of electrical power and to provide a cover for one or more depressions in the primary hydraulically permeable electrode member.

55. The electrolytic method of claim 54 which further comprises the attachment to the primary hydraulically permeable electrode member in a manner such that the secondary hydraulically permeable electrode member is electrically and mechanically attached to the primary hydraulically permeable electrode member.

56. The electrolytic method of claim 55 wherein the primary hydraulically permeable electrode member is attached to the secondary hydraulically permeable electrode member by welding.

57. The electrolytic method of claim 52 wherein a secondary hydraulically permeable electrode member is placed over the primary hydraulically permeable electrode member to provide a secondary distribution of electrical power and to provide a cover for one or more depressions in the primary hydraulically permeable electrode member.

58. The electrolytic method of claim 57 which further comprises the attachment to the primary hydraulically permeable electrode member in a manner such that the secondary hydraulically permeable electrode member is electrically and mechanically attached to the primary hydraulically permeable electrode member.

59. The electrolytic method of claim 58 wherein the primary hydraulically permeable electrode member is attached to the secondary hydraulically permeable electrode member by welding.

60. The electrolytic method of claim 51 wherein a secondary hydraulically permeable electrode member is placed over the primary hydraulically permeable electrode member to provide a secondary distribution of electrical power and to provide a cover for one or more depressions in the primary hydraulically permeable electrode member.

61. The electrolytic method of claim 60 which further comprises the attachment to the primary hydraulically permeable electrode member in a manner such that the secondary hydraulically permeable electrode member is electrically and mechanically attached to the primary hydraulically permeable electrode member.

62. The electrolytic method of claim 61 wherein the primary hydraulically permeable electrode member is attached to the secondary hydraulically permeable electrode member by welding.

63. The electrolytic method of claim 62 wherein the secondary hydraulically permeable electrode member has a greater flexibility than that of the primary hydraulically permeable electrode member.

64. The electrolytic method of claim 50 wherein a secondary hydraulically permeable electrode member is placed over the primary hydraulically permeable electrode member to provide a secondary distribution of electrical power and to provide a cover for one or more depressions in the primary hydraulically permeable electrode member.

65. The electrolytic method of claim 64 which further comprises the attachment to the primary hydraulically permeable electrode member in a manner such that the secondary hydraulically permeable electrode member is electrically and mechanically attached to the primary hydraulically permeable electrode member.

66. The electrolytic method of claim 65 wherein the primary hydraulically permeable electrode member is attached to the secondary hydraulically permeable electrode member by welding.

67. The electrolytic method of claim 64 wherein the depth of one or more depressions from the normally planar surface of the primary hydraulically permeable electrode member is in the range of from about 2 to about 18 millimeters.

68. The electrolytic method of claim 64 wherein the secondary hydraulically permeable electrode member has a thickness in the range of from about 0.1 to about 1 millimeter.

69. The electrolytic method of claim 50 wherein the dept of one or more depressions from the normally planar surface of the primary hydraulically permeable electrode member is in the range of from about 2 to about 18 millimeters.

70. The electrolytic method of claim 50 wherein the volume of one or more depressions is in the range of from about 0.06 cubic centimeter to about 11.6 cubic centimeter.

71. The electrolytic method of claim 50 wherein the primary hydraulically permeable electrode member is attached to the stand-off means by welding.

72. The electrolytic method of claim 50 conducted in a plurality of cells assembled in a filter press type cell series.

73. The electrolytic method of claim 72 wherein alternating cells have the same charge, thereby operating the cell series in a monopolar mode.

74. The electrolytic method of claim 72 wherein each electrode in a cell unit is charged with a different charge, thereby operating the cell series in a bipolar mode.

75. The method of claim 72 wherein a cation exchange membrane is used to separate an anode compartment from a cathode compartment.

76. The method of claim 72 wherein a cation exchange membrane is used to separate an anode compartment from a cathode compartment.

77. The method of claim 50 wherein the primary hydraulically permeable electrode member has a sufficient depression volume located at the mechanical and electrical contact points to allow electrolyte to flow over the point where the depressions contact the stand-off means to maintain a substantially uniform concentration of electrolyte, as compared to the electrolyte adjacent to one or more depressions.

78. The method of claim 50 wherein the primary hydraulically permeable electrode member has a sufficient depression volume at the point where the depressions contact the stand-off means to allow electrolyte to flow over discrete areas of the contact points to sufficiently remove the heat of reaction.

79. The method of claim 50 wherein the primary hydraulically permeable electrode member has a sufficient depression volume at the point where the depressions contact the stand-off means to allow sufficient electrolyte flow to minimize stagnation of chlorine gas in the volume location when the primary hydraulically permeable electrode member is used in a chlor-alkali cell.

80. The method of claim 50 wherein the primary hydraulically permeable electrode member has a sufficient depression volume at the point where the depressions contact the stand-off means to insure a sufficient chloride ion concentration between the membrane and the depressed contact points to maintain oxygen evolution substantially constant, as compared to the oxygen evolution outside one or more depressions.

81. The method of claim 50 wherein a sodium chloride brine solution is electrolyzed.

82. The method of claim 75 wherein the electrode secondary hydraulically permeable electrode member includes a compressible electroconductive mat between the stand off means and the membrane and means are provided to press the electrodes and the membrane together.

83. A cell for chlor-alkali electrolysis having an anodic and a cathodic compartment, containing respectively a foraminous anode and a foraminous cathode separated by a cation exchange membrane;

said anode and said cathode being connected to a stand-off means protruding from a central barrier of said compartments;

at least one of said anode or cathode being in contact with said membrane;

on the side opposite to that in contact with the membrane, said anode or cathode being provided with spaced apart depressions at points where said anode or cathode is connected to said standoff means where a gap results between said membrane and the points of connection to the stands off means;

said anode or said cathode, provided with said spaced apart depressions, further comprising a foraminous sheet interposed between said anode or said cathode and said membrane, to cover a surface of said anode or cathode in contact with said membrane, said depressions included;

said spaced apart depressions functioning to protect the membrane against heat generation occurring in the points of connection to the standoff means and to provide an increased circulation of the electrolyte in the gap between the membrane and the points of connection to the standoff means and further to provide a homogeneous distribution of current in the membrane and at the points of connection to the standoff means.

* * * * *